US008739928B2

(12) United States Patent
Schneider

(10) Patent No.: US 8,739,928 B2
(45) Date of Patent: Jun. 3, 2014

(54) PERSONNEL BASKET

(75) Inventor: William Schneider, Malcolm, NE (US)

(73) Assignee: Westchester Capital, LLC, Omaha, NE (US)

( * ) Notice: Subject to any disclaimer, the term of this patent is extended or adjusted under 35 U.S.C. 154(b) by 299 days.

(21) Appl. No.: 13/200,038

(22) Filed: Sep. 15, 2011

(65) Prior Publication Data

US 2013/0068558 A1 Mar. 21, 2013

(51) Int. Cl.
*E04G 3/00* (2006.01)

(52) U.S. Cl.
USPC ..... 182/2.2; 182/2.3; 182/2.8

(58) Field of Classification Search
USPC ..... 182/2.2, 2.3, 2.8–2.11
See application file for complete search history.

(56) References Cited

U.S. PATENT DOCUMENTS

| | | | | | |
|---|---|---|---|---|---|
| 3,472,337 | A * | 10/1969 | Atchey | 182/2.7 |
| 3,625,307 | A * | 12/1971 | Siefermann et al. | 182/2.5 |
| 4,179,010 | A * | 12/1979 | Ashworth | 182/2.7 |
| 4,314,622 | A * | 2/1982 | Lindquist | 182/2.11 |
| 4,458,780 | A * | 7/1984 | Telfer | 182/2.11 |
| 4,754,840 | A * | 7/1988 | MacDonald et al. | 182/2.3 |
| 4,775,029 | A * | 10/1988 | MacDonald et al. | 182/2.1 |
| 4,838,381 | A * | 6/1989 | Michaud et al. | 182/2.3 |
| 4,953,666 | A * | 9/1990 | Ridings | 187/243 |
| 4,962,827 | A * | 10/1990 | Garnett | 182/2.11 |
| 5,727,645 | A * | 3/1998 | Woodling | 182/2.1 |
| 5,913,379 | A * | 6/1999 | Young et al. | 182/2.7 |
| 6,145,619 | A * | 11/2000 | Risser | 182/113 |
| 7,926,670 | B2 * | 4/2011 | Schneider | 212/168 |
| 2008/0197094 | A1 * | 8/2008 | Bond | 212/300 |

* cited by examiner

*Primary Examiner* — Katherine Mitchell
*Assistant Examiner* — Candace L Bradford
(74) *Attorney, Agent, or Firm* — Dennis L. Thomte; Thomte Patent Law Office LLC

(57) ABSTRACT

A truck mounted telescopic boom structure including a stowable jib boom having a stowable personnel basket mounted thereon is described. A mounting structure is provided at the outer end of the innermost boom section of the boom structure and includes means for pivotally moving a work platform or basket between operative and stowed positions. When the boom structure and the jib boom are in their stowed positions, the personnel basket is positioned closely adjacent the jib boom at one side thereof so as to be within the highway width restrictions. The personnel basket is connected to the outer end of the jib boom at all times without the necessity of removing the personnel basket from the jib boom when the jib boom and the boom structure are in their stowed positions. The width of the personnel basket is adjustable between a first collapsed position and an expanded position.

1 Claim, 15 Drawing Sheets

PERSONNEL BASKET

BACKGROUND OF THE INVENTION

1. Field of the Invention

This invention relates to a selectively expandable personnel basket wherein the width of the same may be selectively increased from a first collapsed or folded position to a second expanded non-collapsed working position. More particularly, this invention relates to a selectively expandable and contractible personnel basket for a truck mounted telescopic boom structure or crane wherein the width of the personnel basket may be reduced when the personnel basket is in its stowed position on the truck so that the width of the truck and boom structure does not exceed highway width restrictions.

2. Description of the Related Art

Truck mounted telescopic boom structures or cranes frequently have a jib boom mounted on the outer end of the innermost boom section to enable the boom structure to perform tasks which would not be possible without the jib boom. The jib booms of the prior art are usually pivotally mounted to the outer end of the innermost boom section so that the jib boom may be pivotally moved between an operative extended position to an inoperative stowed position adjacent one side of the boom structure. A personnel basket, bucket, work platform, etc. is frequently mounted on the outer end of the jib boom. However, if the personnel basket is not disconnected from the jib boom when the jib boom and the boom structure are in their stowed positions, the personnel basket will protrude laterally from the side of the truck and will cause the truck to be "over width." To avoid the "over width" problem, the personnel basket is usually disconnected from the jib boom and stowed on the truck deck or bed or even placed on a trailer or the like. When it is desired to again connect the personnel basket to the jib boom, the boom structure must be extended with the jib boom then being pivoted to its operative position. The personnel basket, which may weigh 200-300 pounds, must then be moved to where the outer end of the jib boom is positioned. The personnel basket must then be properly aligned with the jib boom to enable attachment bolts or pins to be properly placed to connect the basket to the jib boom, which is a difficult task at best, especially if the basket is not positioned on a level surface or if the truck is on an uneven surface.

The problems of the prior art were solved by the invention described in Applicant's prior U.S. Pat. No. 7,926,670. In Applicant's prior invention, the width of the personnel basket thereof was necessarily limited so as not to exceed highway width restrictions when the personnel basket was in its stowed position and the truck was being moved from one location to another.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A truck mounted telescopic boom structure including a stowable jib boom with a stowable personnel basket is disclosed herein. The truck has forward and rearward ends and opposite sides. The truck includes a cab at the forward end thereof and a deck or platform, having rearward and forward ends and opposite sides, which extends rearwardly from the cab. An upstanding pedestal is rotatably mounted, about a vertical axis, on the truck adjacent the rearward end of the deck or platform. A telescoping boom structure, including an elongated outer boom section, having inner and outer ends and opposite sides, with at least one elongated inner boom section telescopically received thereby is provided on the truck with the inner end of the outer boom section being pivotally secured, about a horizontal axis, to the pedestal. The boom structure is selectively movable between an operative position and a stowed position.

An elongated jib boom, having inner and outer ends, is mounted on the boom structure with the inner end of the jib boom being pivotally secured to the outer end of the inner boom section whereby the jib boom is movable between a first operative position and a second stowed position relative to the boom structure. The jib boom, when in its first operative position, is generally parallel to and extends outwardly from the inner boom section. The jib boom, when in its second stowed position, extends from the outer end of the inner boom section towards the inner end of the boom structure adjacent one side of the outer boom section. The first end of an elongated first support is pivotally secured to the outer end of the jib boom about a first axis. The first end of a second elongated support is pivotally secured to the second end of the first support about a second axis which is transverse to the first axis. The first end of a third elongated support is pivotally secured to the second end of a second support about a third axis which is transverse with respect to the first and second axes.

A personnel basket is connected to the second end of the third support. The first, second and third supports and the first, second and third axes permit the third support and the personnel basket to hang downwardly from the outer end of the jib boom when the boom structure is in its operative position and the jib boom is in its operative position. The first, second and third supports and the first, second and third axes permit the second and third supports to extend forwardly from the outer end of the jib boom, when the jib boom structure is in its stowed position and the jib boom is in its stowed position so that the personnel basket may be positioned on the deck of the truck adjacent the jib boom without exceeding highway width restrictions.

The personnel basket of the instant invention is designed so that it has a somewhat narrow width when in its collapsed position but which may be selectively expanded so as to have an increased width when in its working position so as to provide additional space for a worker when using the personnel basket. The personnel basket of this invention may be collapsed for reasons other than to be stowed.

It is therefore a principal object of the invention to provide a truck mounted telescopic boom structure including a stowable jib boom with a stowable personnel basket.

A further object of the invention is to provide a device of the type described which is convenient and safe to use.

A further object of the invention is to provide a personnel basket with the width thereof being expandable to provide an adequate work space within the basket when the basket is being used.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
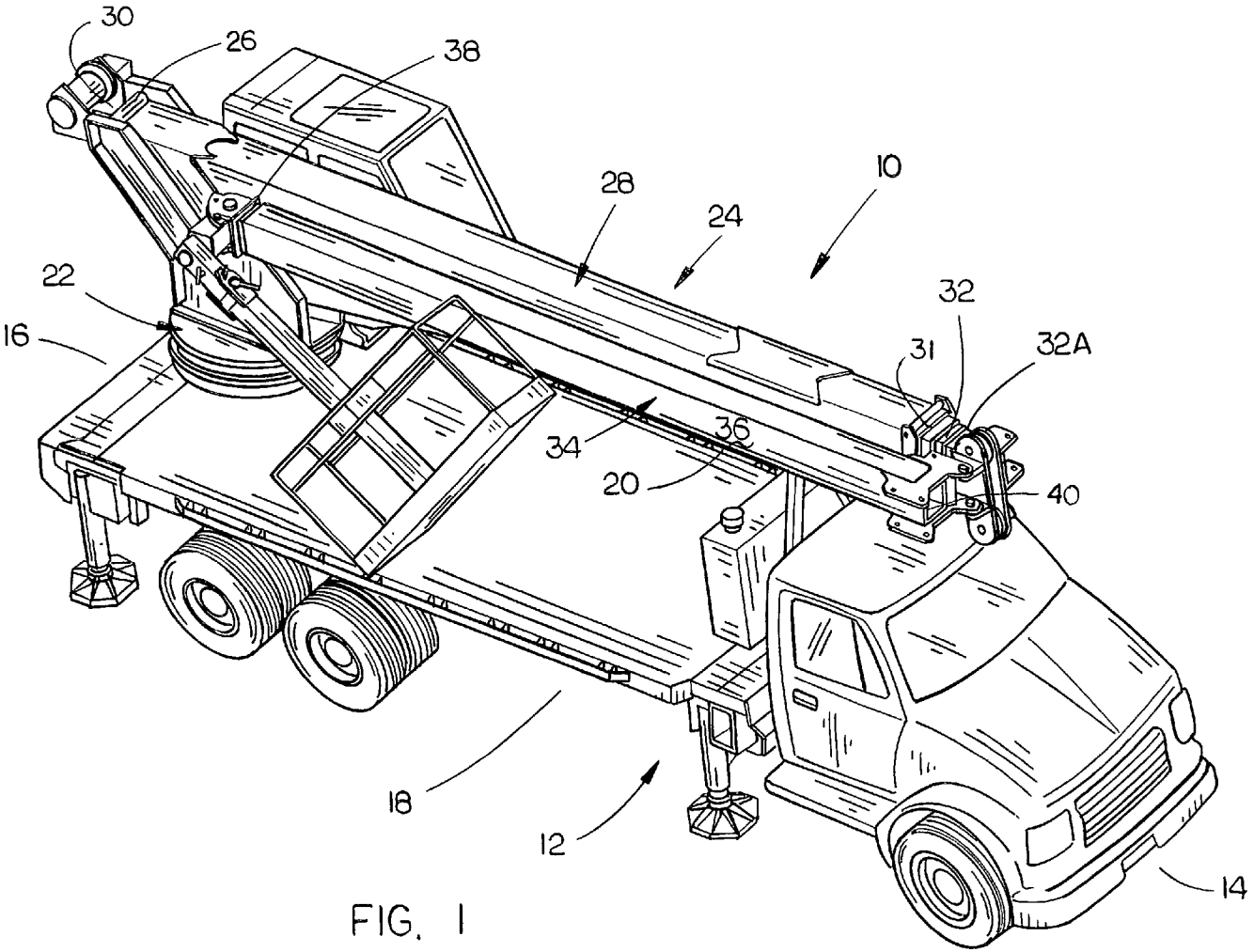
FIG. 1 is a front perspective view of the invention of U.S. Pat. No. 7,926,670 with the telescopic boom structure, jib boom and personnel basket being in their stowed positions.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Inasmuch as the stowable collapsible personnel basket of this invention is ideally suited for use with the truck mounted telescopic boom structure of Applicant's U.S. Pat. No. 7,926,670, FIGS. 1-7 thereof and the description of U.S. Pat. No. 7,926,670 will be included herein to describe the structure with which the present invention may be preferably utilized.

With respect to FIGS. 1-7, of U.S. Pat. No. 7,926,670, the numeral 10 refers generally to a conventional truck mounted boom structure with the numeral 12 referring to the truck or vehicle including a forward end 14, rearward end 16, and opposite sides 18 and 20. The numeral 22 refers to a conventional rotatable pedestal having a telescopic boom structure 24 pivotally secured thereto about a horizontal axis referred to generally by the reference numeral 26.

Boom structure 24 includes an outer boom section 28 having a rearward end 30 and a forward end 31. A plurality of inner boom sections 32 are telescopically and slidably received within one another and within the outer boom section 28. For purposes of description, the innermost inner boom section will be referred to by the reference numeral 32A. The inner boom sections 32 are telescopically moved within outer boom section 28 by conventional structure. Further, the pedestal 22 is rotated with respect to the truck 12 in conventional fashion. Additionally, the boom section 24 is moved upwardly and downwardly by means of conventional hydraulic cylinders.

The numeral 34 refers to a jib boom which will normally include an outer jib boom section 36 and an inner jib boom section 38 which is telescopically movably mounted within outer jib boom section 36. The inner end 40 of jib boom 34 is pivotally secured to the outer end of the innermost boom section 32A so that the jib boom 34 may be pivotally moved from the stowed position as seen in FIG. 1 to an extended position wherein jib boom 34 is parallel to and extends outwardly from the outer end of the boom structure in conventional fashion.

Figure 2:
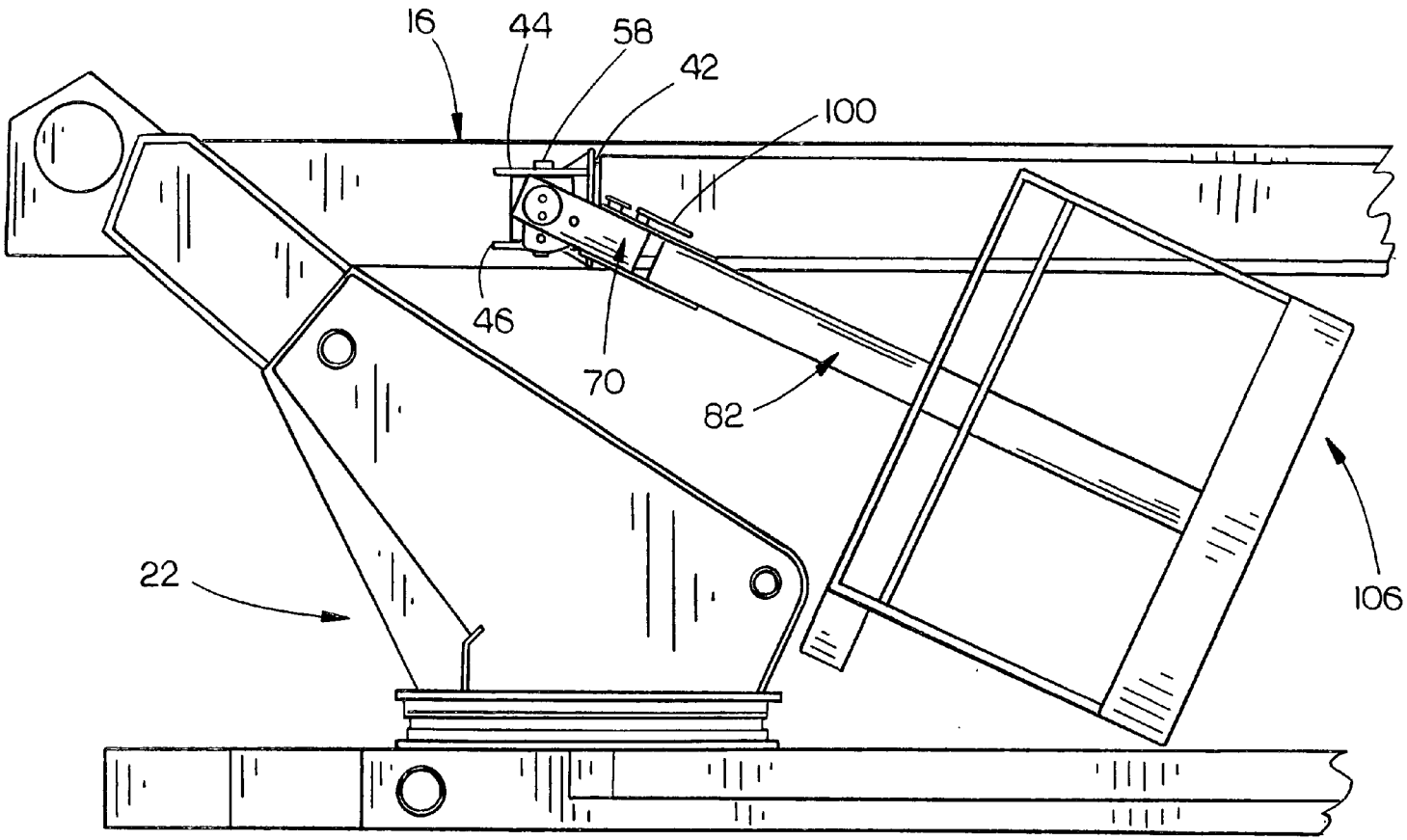
FIG. 2 is a partial side view of the invention of U.S. Pat. No. 7,926,670 with the boom structure, jib boom and personnel basket being in their stowed positions.
Figure 3:
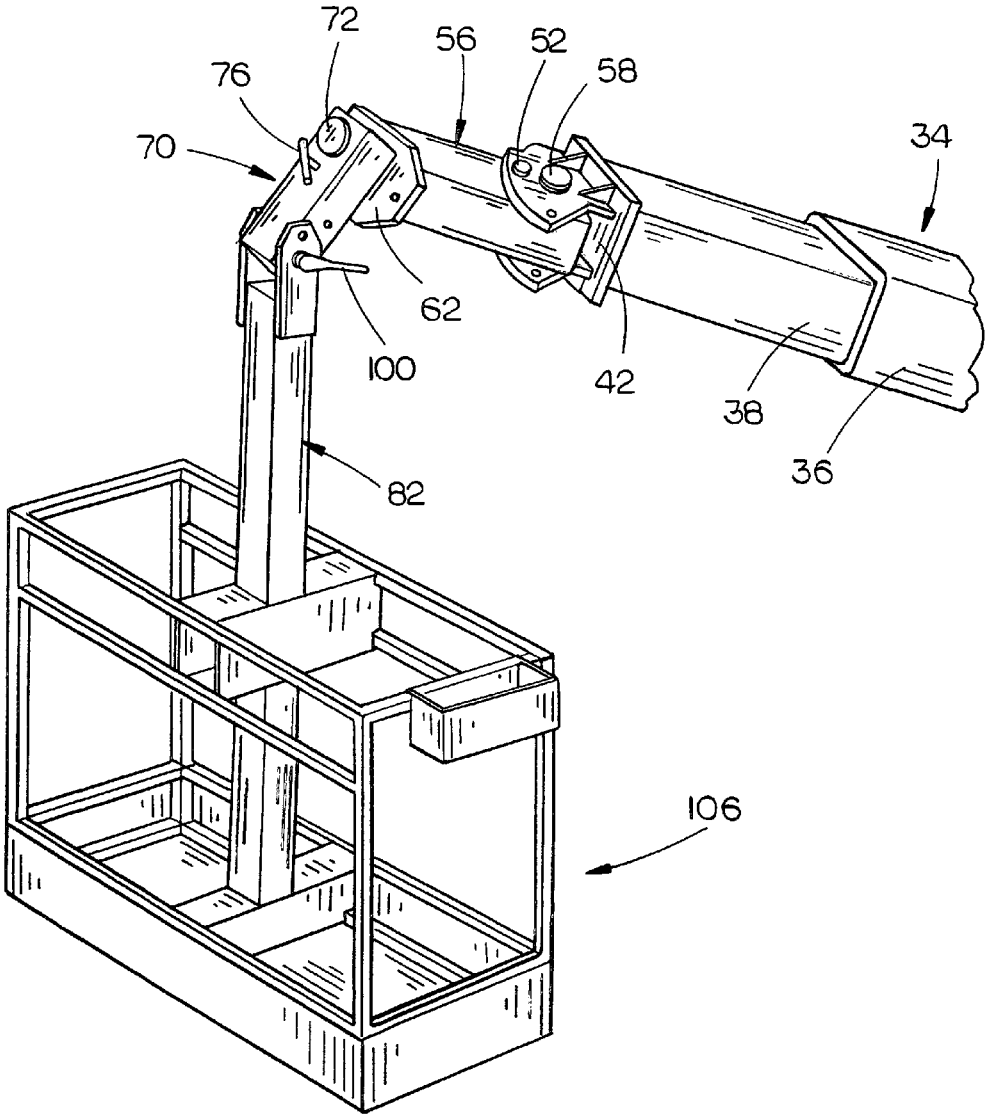
FIG. 3 is a partial rear perspective view of the personnel basket and the structure of U.S. Pat. No. 7,926,670 which mounts the personnel basket to the outer end of the jib boom of U.S. Pat. No. 7,926,670.
Figure 4:
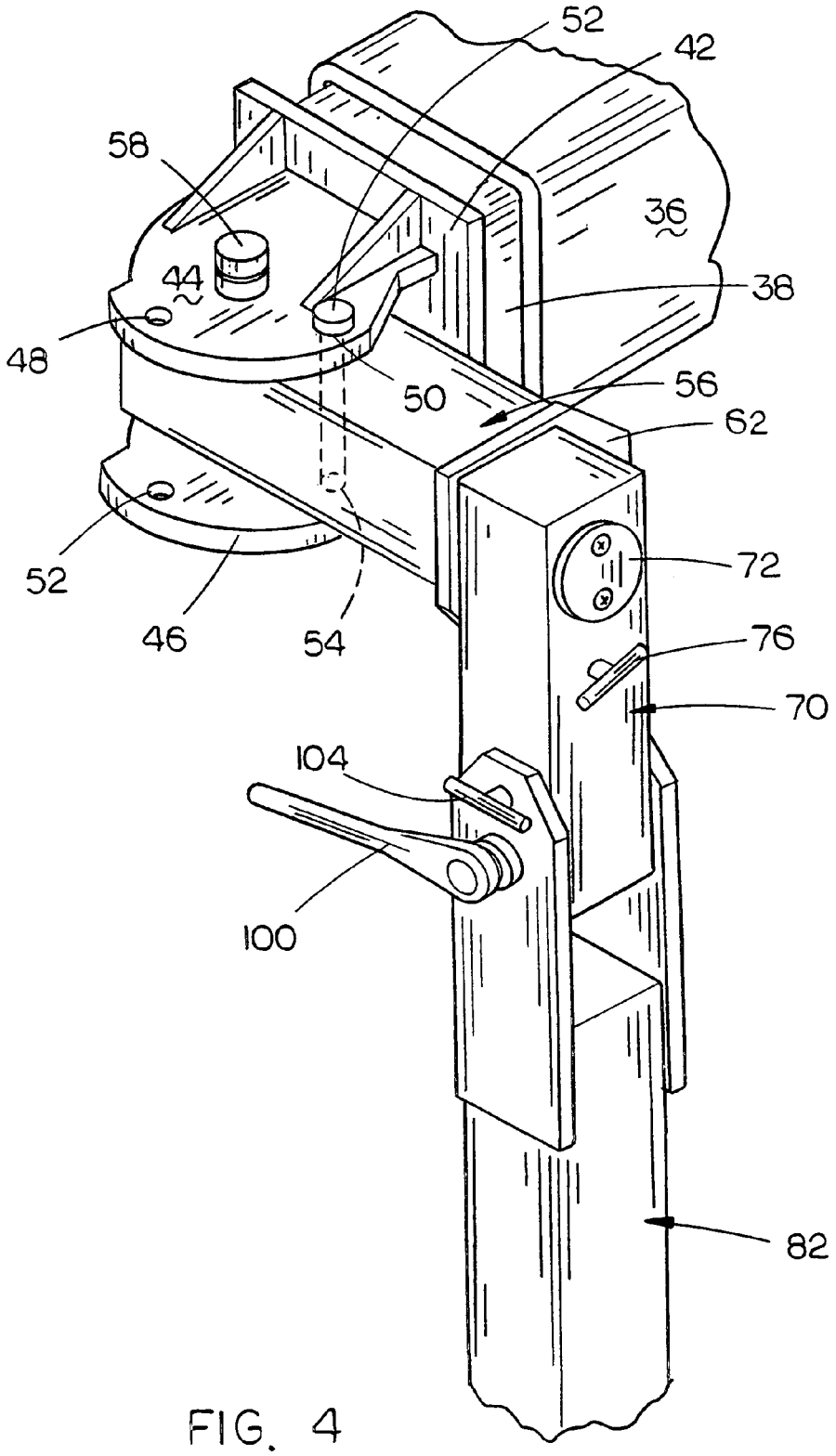
FIG. 4 is a partial perspective view of the mounting structure for mounting the personnel basket to the outer end of the jib boom.

Plate 42 is welded to the outer end of inner jib boom section 38 and has a pair of plates 44 and 46 welded thereto and which extend outwardly therefrom in a vertically spaced-apart manner (FIG. 2). Plate 44 is provided with a pair of openings 48 and 50 formed therein which are adapted to selectively receive a locking pin or bolt 52 therein (FIG. 4). Similarly, plate 46 includes openings 52 and 54 formed therein which register with openings 48 and 50 and which are adapted to receive the locking pin 52 as will be described hereinafter (FIG. 4).

Figure 5:
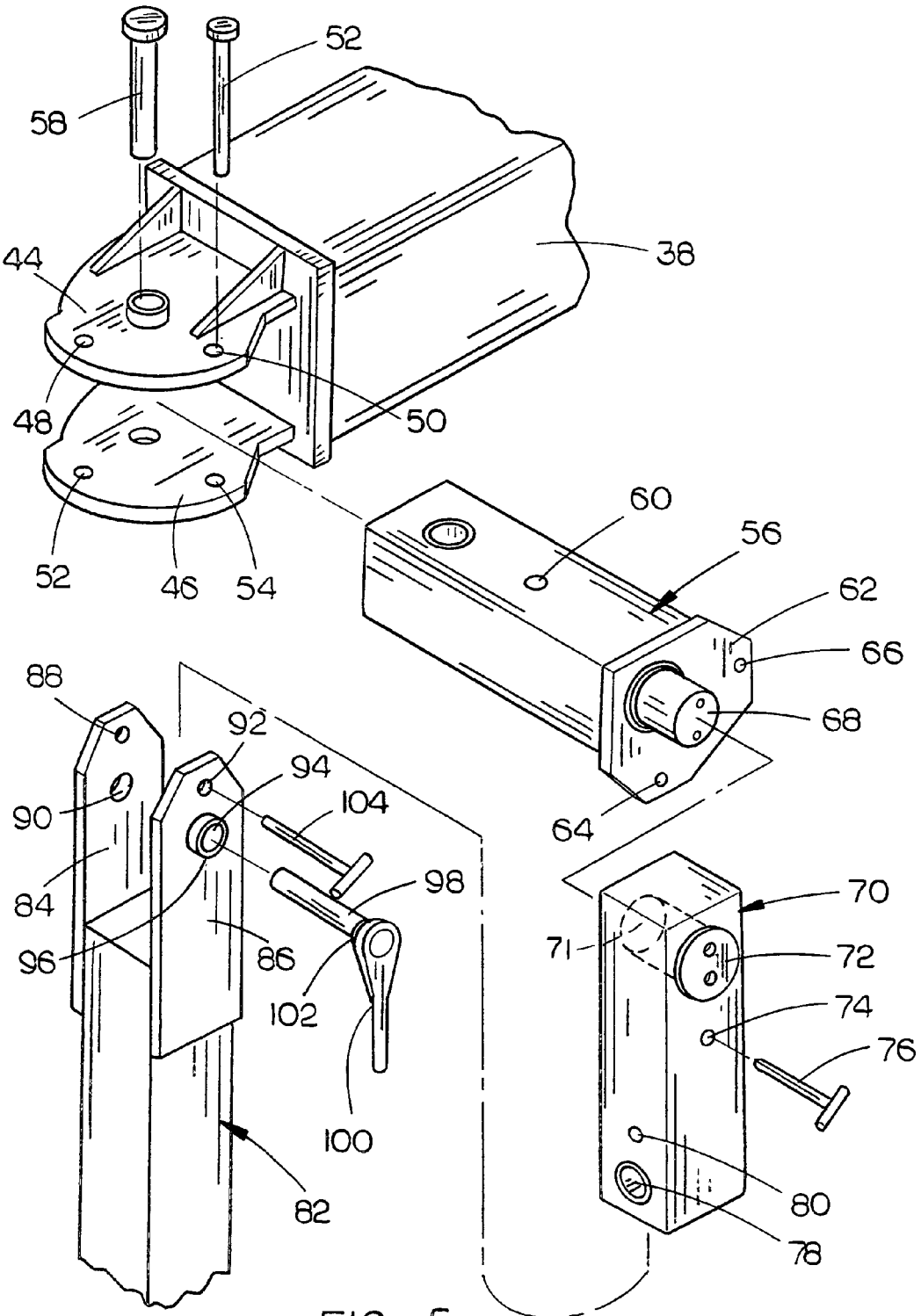
FIG. 5 is an exploded perspective view of the structure of FIG. 4.
Figure 6:
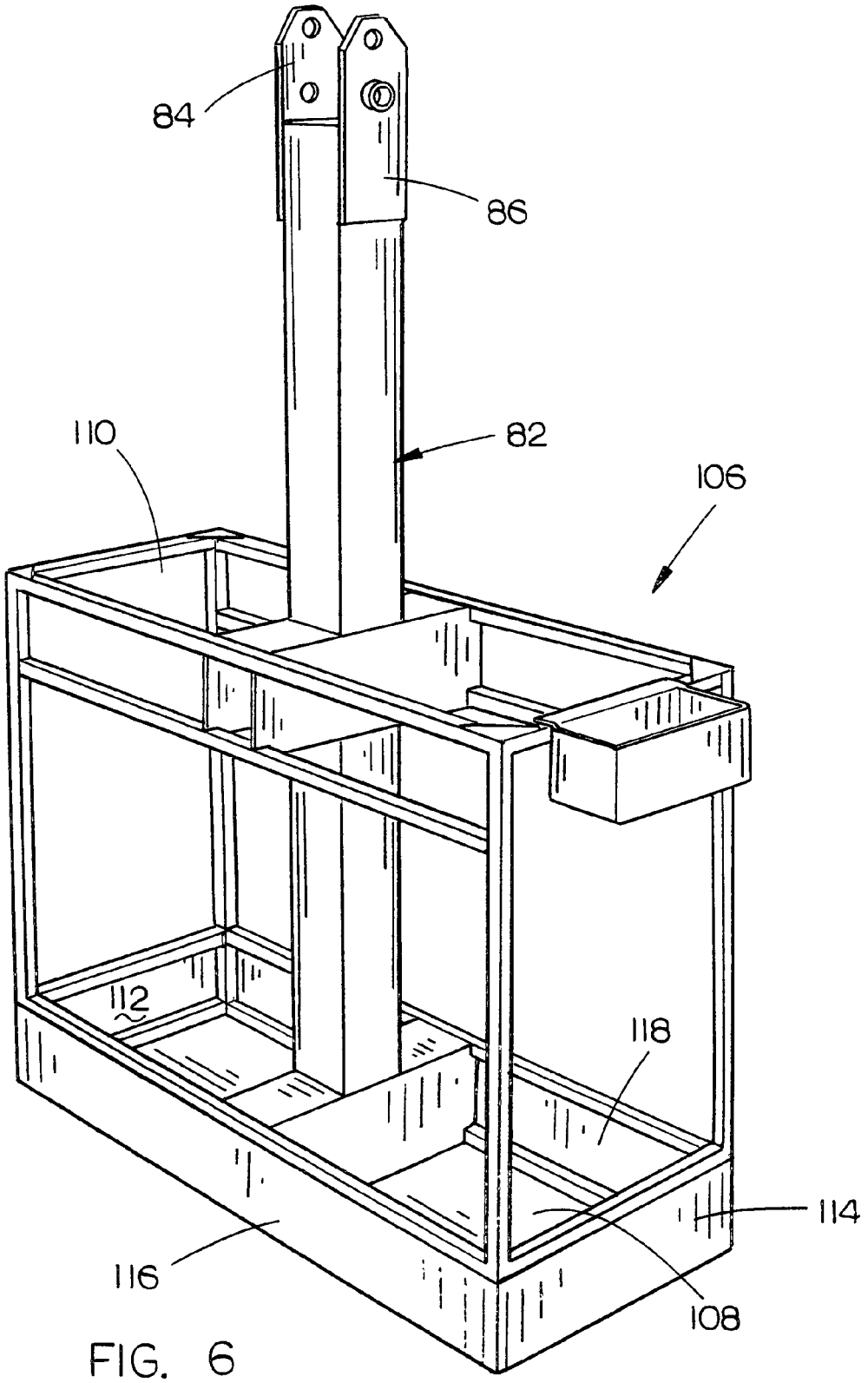
FIG. 6 is a perspective view of the personnel basket of the invention of U.S. Pat. No. 7,926,670.
Figure 7:
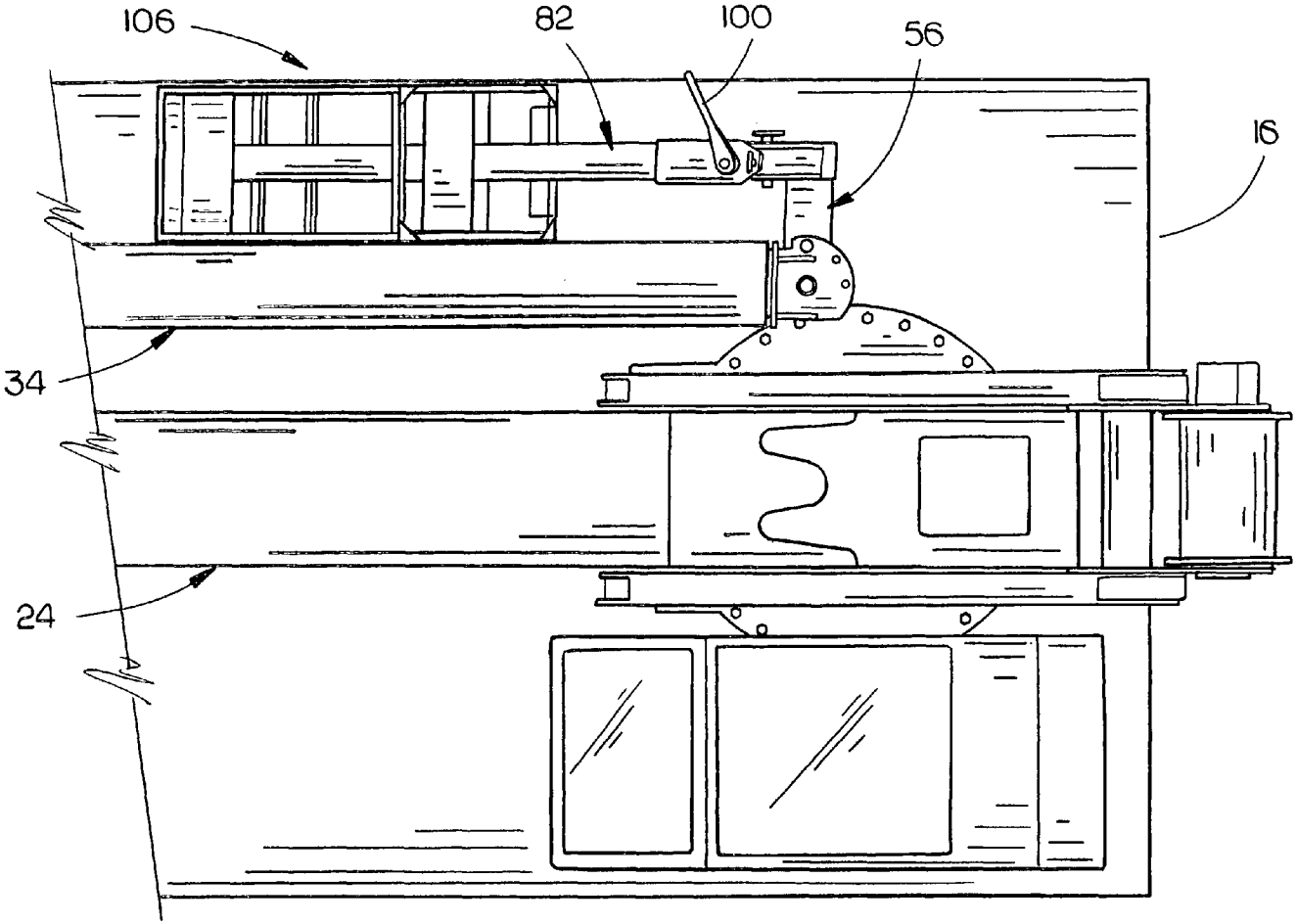
FIG. 7 is a partial top view illustrating the boom structure, jib boom and personnel basket of U.S. Pat. No. 7,926,670 in their stowed positions.

The numeral 56 refers to an elongated support having one end thereof pivotally secured to the plates 44 and 46 by pivot pin 58. For purposes of description, pivot pin 58 will be described as providing a first axis. Support 56 has an opening 60 extending therethrough which is adapted to register with the openings 50-54 and 48-52 so that the support 56 may be locked in two different positions as will be described hereinafter. The other end of support 56 has a plate 62 welded thereto which has openings 64 and 66 formed therein (FIG. 5). The numeral 68 refers to a pivot pin which extends outwardly from the support 56 through the plate 62.

The numeral 70 refers to a second support having an opening 71 formed in its upper end which receives the pivot pin 68 to pivotally mount the support 70 on the support 56. The pivot pin 68 will be referred to as providing a second axis. Support 70 includes a retainer plate 72 which is secured to the outer end of the pivot pin 68 to maintain support 70 on pivot pin 68 on support 56. Support 72 has an opening 74 extending therethrough which is adapted to register with either of the openings 64 and 66 so that a locking pin 76 may be extended through the opening 74 into either the opening 64 or the opening 66. The other end support 70 has a bore 78 formed therein and an opening 80 extending therethrough.

Figure 8:
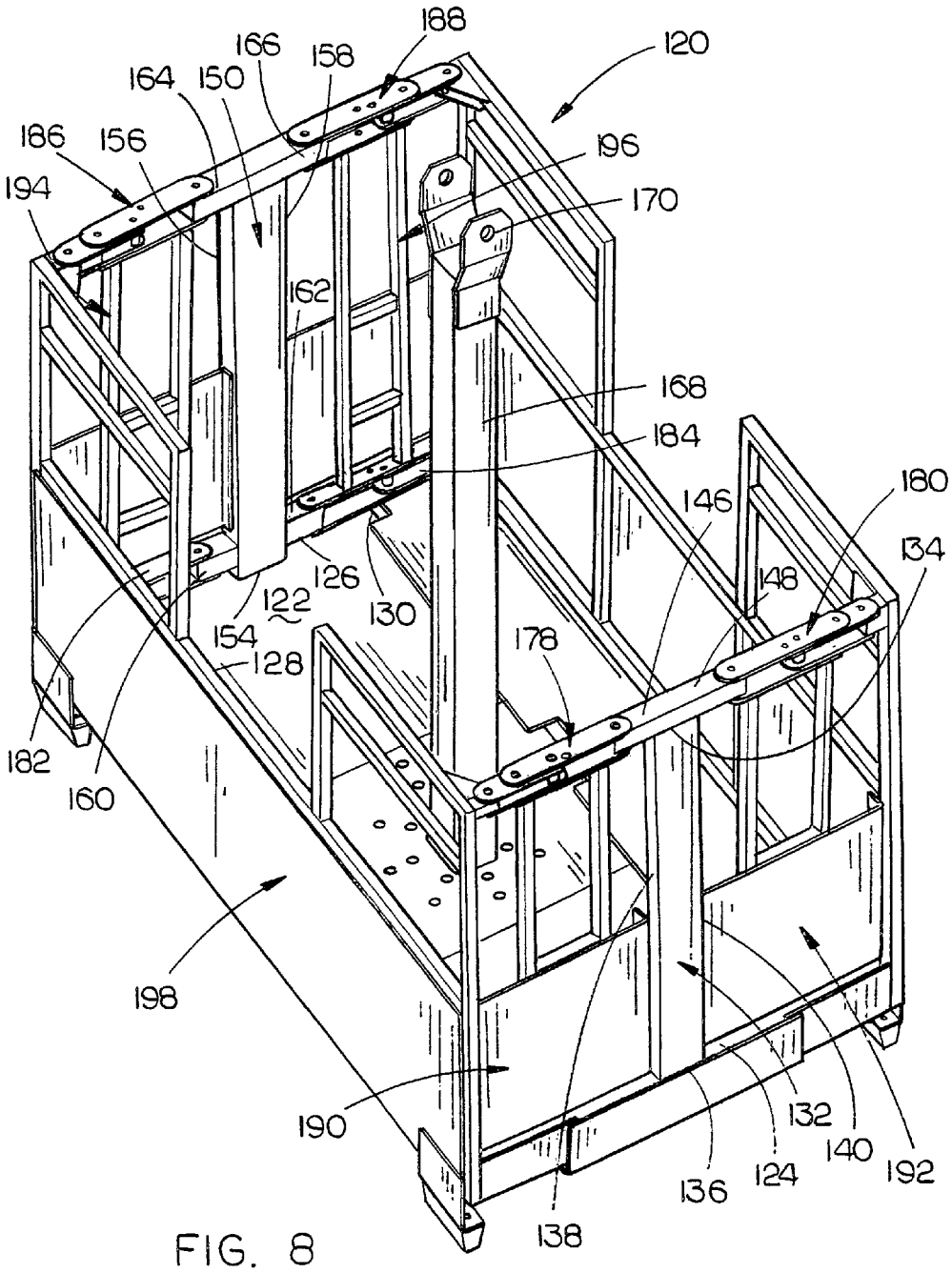
FIG. 8 is a perspective view of the personnel basket of this invention in its non-collapsed position or working position.

The numeral 82 refers to a third support having a pair of spaced-apart plates 84 and 86 secured thereto by welding (FIG. 5). Plate 84 includes openings 88 and 90 while plate 86 includes openings 92 and 94. An internally threaded bushing 96 is positioned in the opening 94, and is adapted to receive the pivot pin 98 extending therethrough and through opening 78. Handle 100 is secured to pin 98 with the pin 98 having external threads 102 which may be threadably secured to the threaded bushing 96. The numeral 104 refers to a locking pin which is adapted to be extended through the opening 92, opening 80 in support 70 and opening 88 (FIG. 8).

The numeral 106 refers to the personnel basket of U.S. Pat. No. 7,926,670 which is preferably rectangular in shape and which has a closed bottom or lower end 108, an open upper end 110, end portions 112 and 114 and side portions 116 and 118. Support 82 is secured to the basket 106 by any convenient means such as by welding or the like.

In normal use, when the jib boom 34 and the personnel basket 106 are not needed, the jib boom 34 will remain in its stowed position adjacent outer boom 28 at one side thereof. In that position, support 56 will be disposed at a right angle with respect to the longitudinal axis of jib boom 34 and with pin 52 being positioned in opening 50 in plate 44, opening 60 in support 56, and opening 54 in plate 46. Support 70 will be positioned so as to be generally parallel to the longitudinal axis of jib boom 34 with pin 76 extending through opening 74 in support 70 and opening 66 in support 56. Support 82 will be positioned with respect to support 70 by extending pin 104 through opening 92 in plate 86, through opening 74 in support 70, and through opening 88 in plate 84. If the boom structure 34 and the jib boom are in their stowed positions, the basket 106 will be in the stowed position of FIGS. 1, 2 and 7 closely adjacent the jib boom 34 so as not to exceed the highway width restrictions.

If the jib boom 34 is to be used, the jib boom 34 is pivotally movable to its operative position wherein the jib boom 34 extends outwardly from the inner boom section 32A parallel thereto. Support 56 will be pivoted so as to be parallel to inner boom section 32A with the pin 52 being extended through opening 48 in plate 44, opening 60 in support 56 and through opening 52 in plate 46. Pin 76 will be removed from opening 74 in support 70 and opening 66 in plate 62 of support 56 which will permit support 70 to freely pivot about pivot pin 68. If desired, pin 76 may be inserted through opening 74 in support 76 and through opening 64 in plate 62. At that same time, pin 104 is removed from opening 92 in plate 86, opening 80 in support 70 and opening 88 in plate 84 so that support 82 and basket 106 may freely pivot with respect to the jib boom about the axis defined by pin 98. When it is desired to stow the jib boom 34 and the basket 106, the above described procedure is reversed.

Although the invention of FIGS. 1-7 works extremely well, the width of the basket 10*b* is somewhat limited due to the width restrictions placed upon the truck or vehicle when traveling upon a highway with the basket in its stowed position on the truck.

The improved personnel basket of this invention is illustrated in FIGS. 8-15, 15A and 16 and is designated by the reference numeral 120. Although the personnel basket of this invention is ideally suited for use with the boom structure of U.S. Pat. No. 7,926,670, the selectively collapsible personnel basket of this invention is ideally suited for use with any aerial lift or boom structures. The collapsible feature of the personnel basket is useful in situations other than for stowage. Basket 120 includes a generally rectangular and horizontally disposed floor 122 having a first end 124, a second end 126, a first side 128 and a second side 30. The numeral 132 refers to a first upstanding support post having an upper end 134, a lower end 136, a first side 138 and a second side 140. The lower end 136 of the first support post 132 is secured to the floor 122 at the first end 124 thereof intermediate the first and second sides thereof. The first support post 132 has a first lower hinge bracket 142 secured thereto which extends laterally therefrom from the first side 138 adjacent the lower end thereof. The first support post 132 has a second lower hinge bracket 144 extending laterally therefrom at the second side 140 thereof adjacent the lower end thereof.

The first support post 132 has a first upper hinge bracket 146 extending therefrom from the first side 138 thereof adjacent the upper end thereof. The first support post 132 has a second upper hinge bracket 148 extending therefrom from the second side 140 thereof adjacent the upper end thereof.

The numeral 150 refers to a second upstanding support post having an upper end 152, a lower end 154, a first side 156 and a second side 158. The lower end of the second support post 150 is secured to the floor 122 at the second end 126 thereof intermediate the first and second sides thereof. The second support post 150 has a first lower hinge bracket 160 extending therefrom at the first side 156 thereof adjacent the lower end thereof. The second support post 150 has a second lower hinge bracket 162 extending therefrom at the second side 158 thereof adjacent the lower end thereof. The second support post 150 has a first upper hinge bracket 164 extending therefrom at the first side 156 thereof adjacent the upper end thereof. The second support post 150 also has a second upper hinge bracket 166 extending therefrom at the second side 158 thereof adjacent the upper end thereof.

The numeral 168 refers to a third upstanding support post having an upper end 170 and a lower end 172. The lower end 172 of the third post 168 is secured to the floor 122 intermediate the ends 124 and 126 thereof and intermediate the sides 128 and 130 thereof.

The numeral 174 refers to a first horizontally disposed hinge assembly, having inner and outer ends, which is selectively movable between extended and folded positions. The inner end of the first hinge assembly 174 is pivotally secured, about a vertical axis, to the first lower hinge bracket 142 on the first support post 132. The numeral 176 refers to a second horizontally disposed hinge assembly, having inner and outer ends, which is selectively movable between extended and folded positions. The inner end of the second hinge assembly 176 is pivotally secured, about a vertical axis, to the second lower hinge bracket 144 on the first support post 132. The numeral 178 refers to a third horizontally disposed hinge assembly having inner and outer ends, which is selectively movable between extended and folded positions. The inner end of the third hinge assembly 178 is pivotally secured, about a vertical axis, to the first upper hinge bracket 146 on the first support post 132. The numeral 180 refers to a fourth horizontally disposed hinge assembly, having inner and outer ends, which is selectively movable between extended and folded positions. The inner end of the fourth hinge assembly 180 is pivotally secured, about a vertical axis, to the second upper hinge bracket 148 on the first support post 132.

A fifth horizontally disposed hinge assembly 186, having inner and outer ends, is selectively movable between extended and folded positions. The inner end of the fifth hinge assembly 186 is pivotally secured, about a vertical axis, to the first lower hinge bracket 160 on the second support post 150. A sixth horizontally disposed hinge assembly 184, having inner and outer ends, is selectively movable between extended and folded positions. The inner end of the sixth hinge assembly 184 is pivotally secured, about a vertical axis, to the second lower hinge bracket 162 on the second support post 150. A seventh horizontally disposed hinge assembly 186, having inner and outer ends, is selectively movable between extended and folded positions. The inner end of the seventh hinge assembly 186 is pivotally secured, about a vertical axis, to the upper hinge bracket 160 on the second support post 150. The numeral 188 refers to an eighth horizontally disposed hinge assembly, having inner and outer ends, which is selectively movable between extended and folded positions. The inner end of the eighth hinge assembly 188 is pivotally secured, about a vertical axis, to the second upper hinge bracket 166 on the second support post 150.

As will be described in more detail hereinafter, each of the hinge assemblies 178, 180, 186 and 188 may be selectively locked in their extended and collapsed positions. If desired, the other hinge assemblies could also be selectively locked in their extended and collapsed positions.

The numeral 190 refers to a first, generally rectangular upstanding end wall having upper and lower ends and inner and outer sides. The lower ends of the vertically disposed bars 330 and 332 of first end wall 190 are secured to the upper hinge plate of first hinge assembly 174 for movement therewith. The upper ends of the vertical bars 330 and 332 of the first end wall 190 are secured to the lower hinge plate of the third hinge assembly 178 for movement therewith.

The numeral 192 designates a second upstanding, generally rectangular end wall having upper and lower ends and inner and outer sides. The lower ends of the vertical bars of the second end wall 192 are secured to the upper hinge plate of the second hinge assembly 176 for movement therewith. The upper ends of the vertical bars of the second end wall 192 are secured to the lower hinge plate of the fourth hinge assembly 180 for movement therewith.

The numeral 194 designates a third, generally rectangular upstanding end wall having upper and lower ends and inner and outer sides. The lower ends of the vertical bars of the third end wall 194 are secured to the upper hinge plate of the fifth hinge assembly 182 for movement therewith. The upper ends of the vertical bars of the third end wall 194 are secured to the lower hinge plate of the seventh hinge assembly 186 for movement therewith. The numeral 196 refers to a fourth upstanding, generally rectangular end wall having upper and lower ends and inner and outer sides. The lower ends of the vertical bars of the fourth end wall 196 are secured to the upper hinge plate of the sixth hinge assembly 184 for movement therewith. The upper ends of the vertical bars of end wall 196 are secured to the lower hinge plate of hinge assembly 188 for movement therewith.

Figure 15:
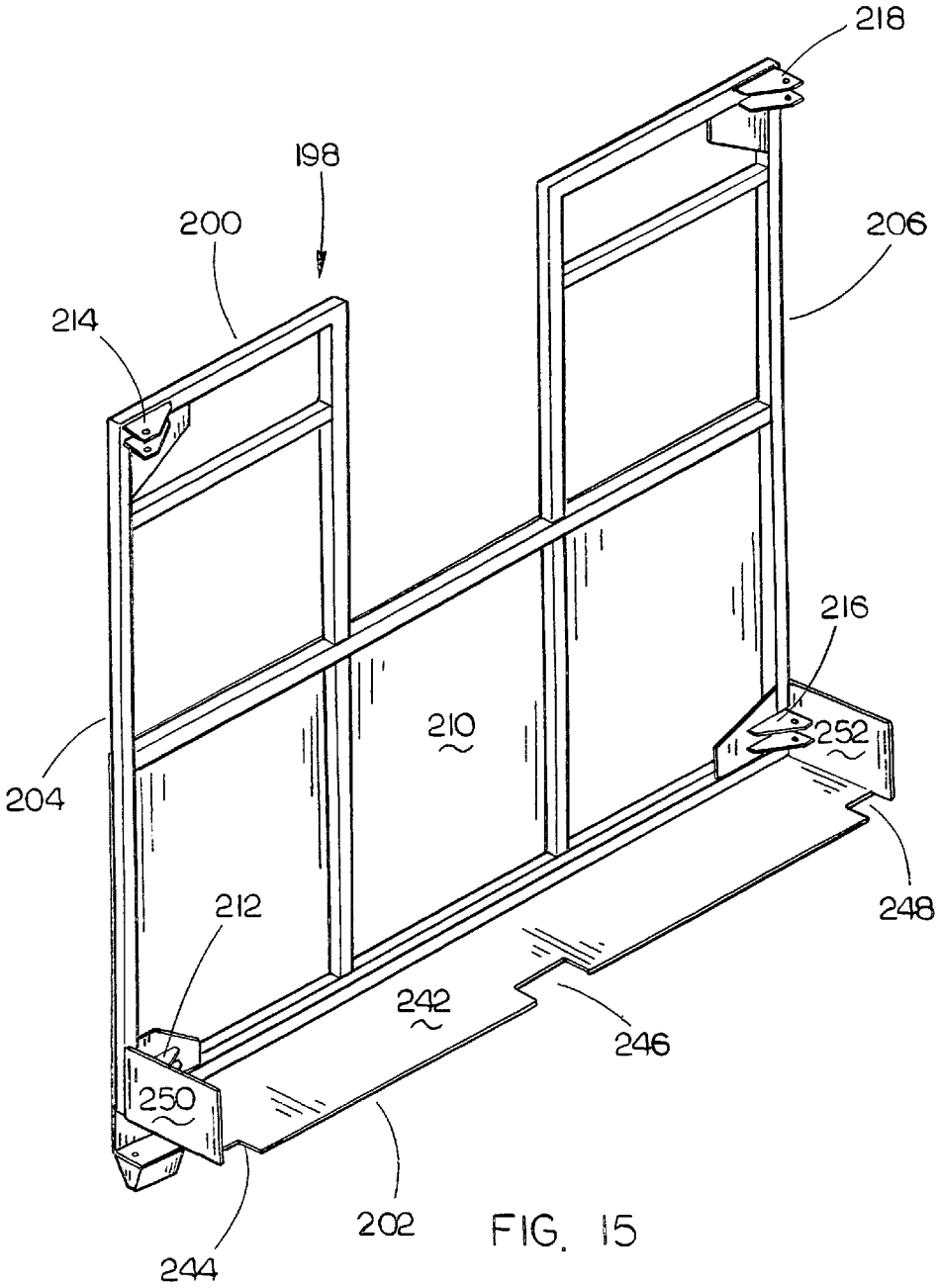
FIG. 15 is a perspective view of one of the side walls of the personnel basket of this invention.

The numeral 198 refers to a first upstanding side wall having an upper end 200, a lower end 202, a first end 204, a second end 206, and outer side 208 and an inner side 210 (FIG. 15). The first side wall 198 has a first lower hinge bracket 212 extending inwardly from the inner side thereof adjacent the lower end thereof at the first end 204 thereof. The first side wall 198 has a first upper hinge bracket 214 extending inwardly from the inner side thereof adjacent the upper end thereof at the first end 204 thereof. Additionally, the first side wall 198 has a second lower hinge bracket 216 extending inwardly from the inner side thereof adjacent the lower end thereof at the second end 206 thereof. The first side wall 198 has a second upper hinge bracket 218 extending inwardly from the inner side thereof adjacent the upper end thereof at the second end 206 thereof.

The outer end of the first hinge assembly 174 is pivotally secured, about a vertical axis, to the first lower hinge bracket 212 of the first side wall 198. The outer end of the third hinge assembly 178 is pivotally secured, about a vertical axis, to the first upper hinge bracket 214 of the first side wall 198. The outer end of the fifth hinge assembly 182 is pivotally secured, about a vertical axis, to the second lower hinge bracket 216 of the first side wall 198. The outer end of the seventh hinge assembly 186 is pivotally secured, about a vertical axis, to the second upper hinge bracket 218 of the first side wall.

Figure 15A:
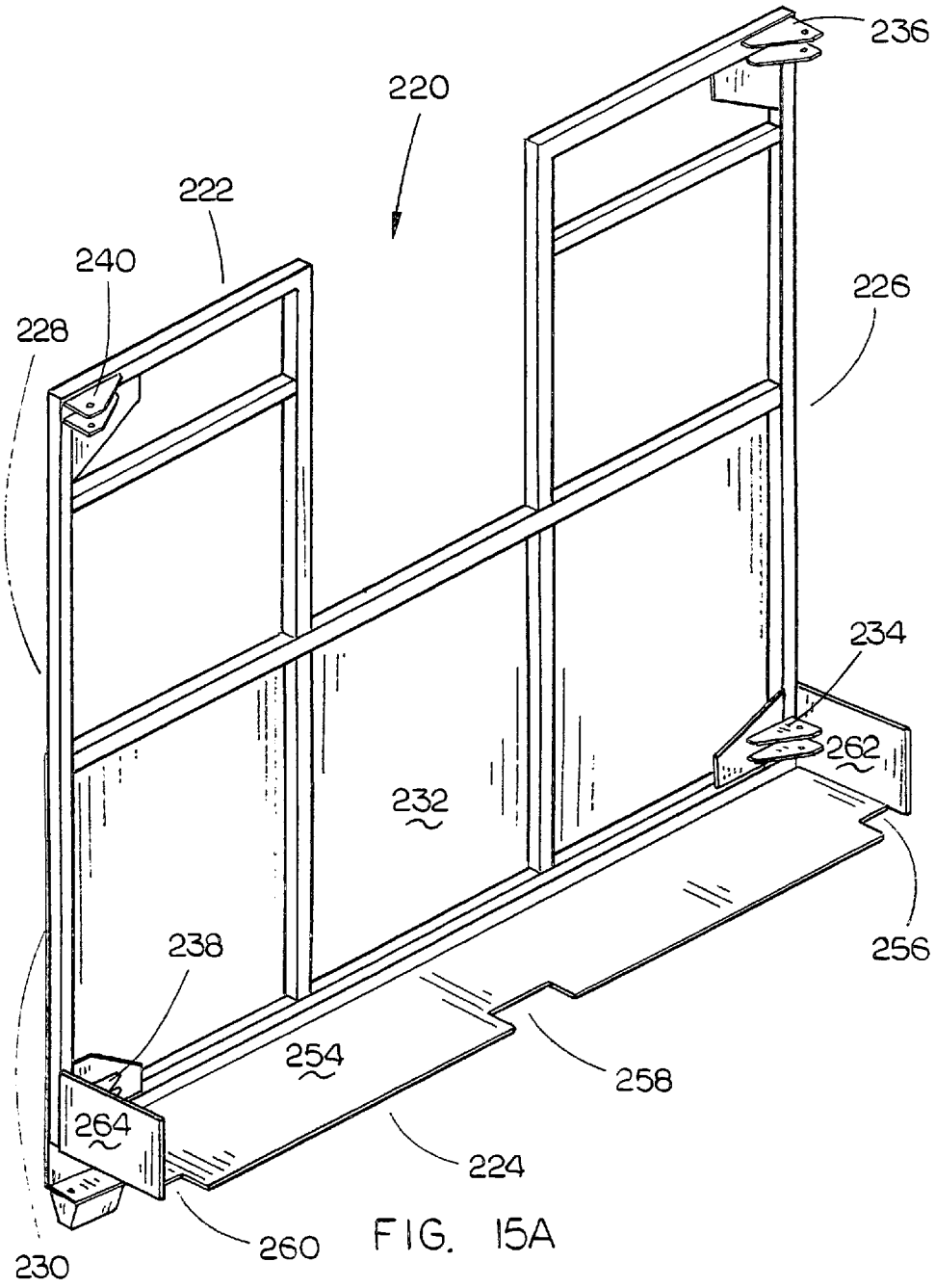
FIG. 15A is a perspective view of the other side wall of the personnel basket of this invention.
Figure 16:
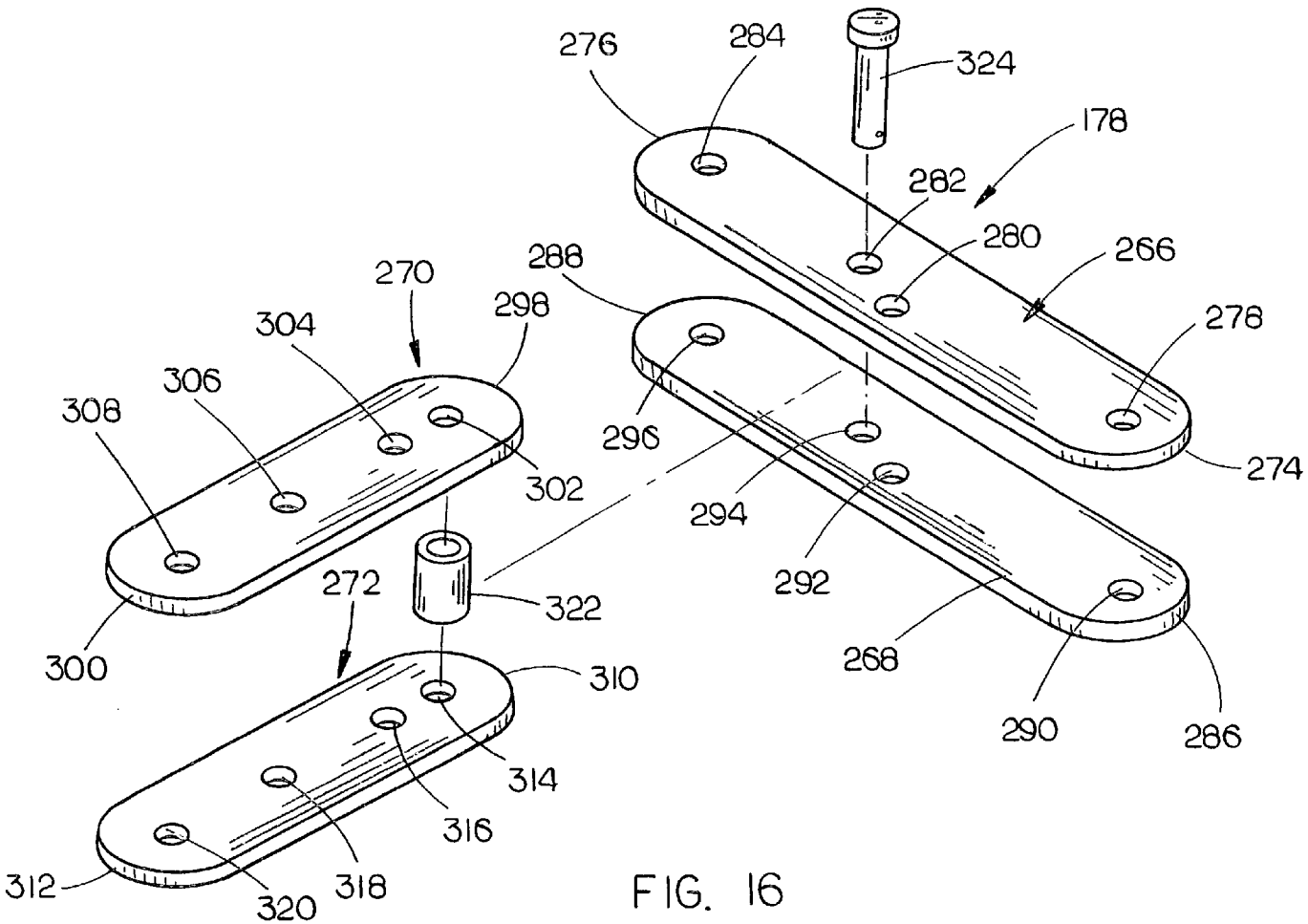
FIG. 16 is an exploded perspective view of the hinge assemblies of this invention.

The numeral 220 refers to a second upstanding side wall having an upper end 222, a lower end 224, a first end 226, a second end 228, an outer side 230 and an inner side 232 (FIG. 15A). A first lower hinge bracket 234 is secured to the second side wall 220 and extends inwardly from the inner side thereof adjacent the lower end thereof at the first end 228 thereof. The second side wall also has a first upper hinge bracket 236 secured thereto which extends inwardly from the inner side thereof adjacent the upper end thereof at the first end 228. The second side wall has a second lower hinge bracket 238 which extends inwardly from the inner side thereof adjacent the lower end thereof at the second end 228. The second side wall also has a second upper hinge bracket 240 which extends inwardly from the inner side thereof adjacent the upper end thereof at the second end 228.

The outer end of the second hinge assembly 176 is pivotally secured, about a vertical axis, to the first lower hinge bracket 234 of the second side wall 220. The outer end of the fourth hinge assembly 180 is pivotally secured, about a vertical axis, to the first upper hinge bracket 236 of the second side wall 220. The outer end of the sixth hinge assembly 184 is pivotally secured, about a vertical axis, to the second lower hinge bracket 238 of the second side wall 220. The outer end of the eighth hinge assembly 188 is pivotally secured, about a vertical axis, to the second upper hinge bracket 240 of the second side wall 220.

The first side wall 198 has a horizontally disposed floor portion 242 at its lower end which extends inwardly therefrom for slidable engagement with the upper surface of the floor 122 of the basket 120. The inner end of floor 242 has cut-outs 244, 246 and 248 which are adapted to receive the posts 132, 168 and 150 respectively when the basket 120 is in its folded or collapsed position. A vertically disposed shield 250 extends inwardly from side wall 198 at end 204. A vertically disposed shield 252 extends inwardly from side wall 198 at end 206 (FIG. 15).

The second side wall 220 (FIG. 15A) has a horizontally disposed floor portion 254 at its lower end which extends inwardly therefrom for slidable engagement with the upper surface of the floor of the basket. The inner end of the floor 254 has cut-outs 256, 258 and 260 formed therein which are adapted to receive the posts 132, 168 and 150 respectively when the basket 120 is in its folded or collapsed position. A vertically disposed shield 262 extends inwardly from side wall 220 at end 226. A vertically disposed shield 264 extends inwardly from side wall 220 at end 228. The floors 242 and 254 are slidably positioned on the upper side of the floor 122 which adds rigidity to the floor when the basket is in its extended or expanded position.

Inasmuch as the hinge assemblies 178, 180, 186 and 188 are identical, only hinge assembly 178 will be described in detail. Hinge assemblies 174, 176, 182 and 184 are identical to hinge assemblies 178, 180, 186 and 188 except that the hinge assemblies are only optionally locked in their folded and extended positions. Hinge assembly 178 includes an upper hinge plate 266 and a lower hinge plate 268 which are identical. Hinge assembly 178 also includes intermediate hinge plates 270 and 272 which are identical. Upper hinge plate 266 has an inner end 274 and an outer end 276. Hinge plate 266 has openings 278, 280, 282 and 284 formed therein. Lower hinge plate 268 has an inner end 286 and an outer end 288. Hinge plate 268 has openings 290, 292, 294 and 296 formed therein which register with openings 278, 280, 282 and 284 respectively.

Hinge plate 270 has an inner end 298 and an outer end 300. Hinge plate 270 has openings 302, 304, 306 and 308 formed therein. Hinge plate 272 has an inner end 310 and an outer end 312. Hinge plate 272 has openings 314, 316, 318 and 320 formed therein which register with openings 302, 304, 306 and 308 in hinge plate 270. The inner ends of hinge plates 270 and 272 are positioned between hinge plates 266 and 268 so that the opening 302 and hinge plate 270 and opening 314 and hinge plate 272 are aligned with opening 282 and hinge plate 266 and opening 294 and hinge plate 268. Spacer 322 is positioned between hinge plates 270 and 272 in alignment with openings 302 and 314. Pivot pin 324 is then extended downwardly through opening 282, opening 302, through spacer 322, through 314 and through opening 294. A cotter key or pin is then inserted through the lower end of pin 324 to hold it in place.

The inner ends of hinge plates 266 and 268 are pivotally secured to hinge bracket 146 by a suitable pivot pin 326. The outer ends of hinge plates 270 and 272 are pivotally secured to hinge bracket 214 of side wall 198 by a pivot pin 328.

Figure 11:
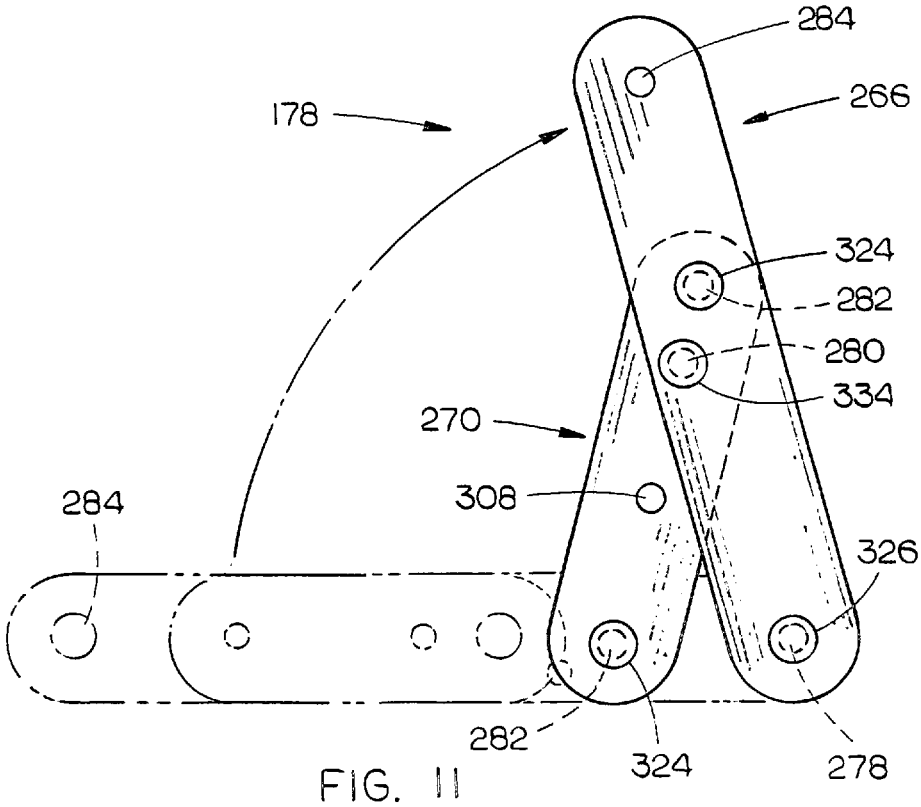
FIG. 11 is a top elevational view of the hinge assembly of FIG. 10 but which illustrates the hinge assembly in its second locked position which maintains the personnel basket in its folded or stowed position.
Figure 13:
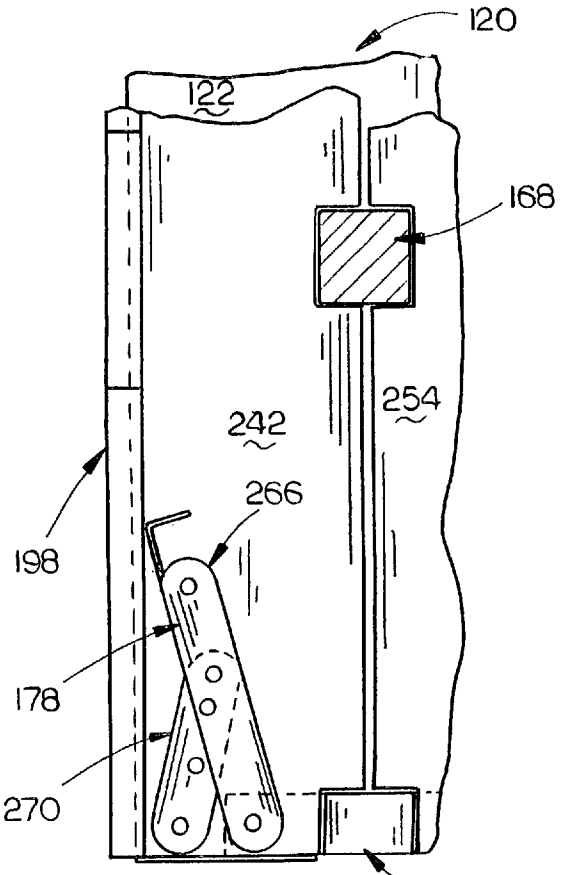
FIG. 13 is a view similar to FIG. 12 except that the personnel basket is in its collapsed or stowed position.
Figure 12:
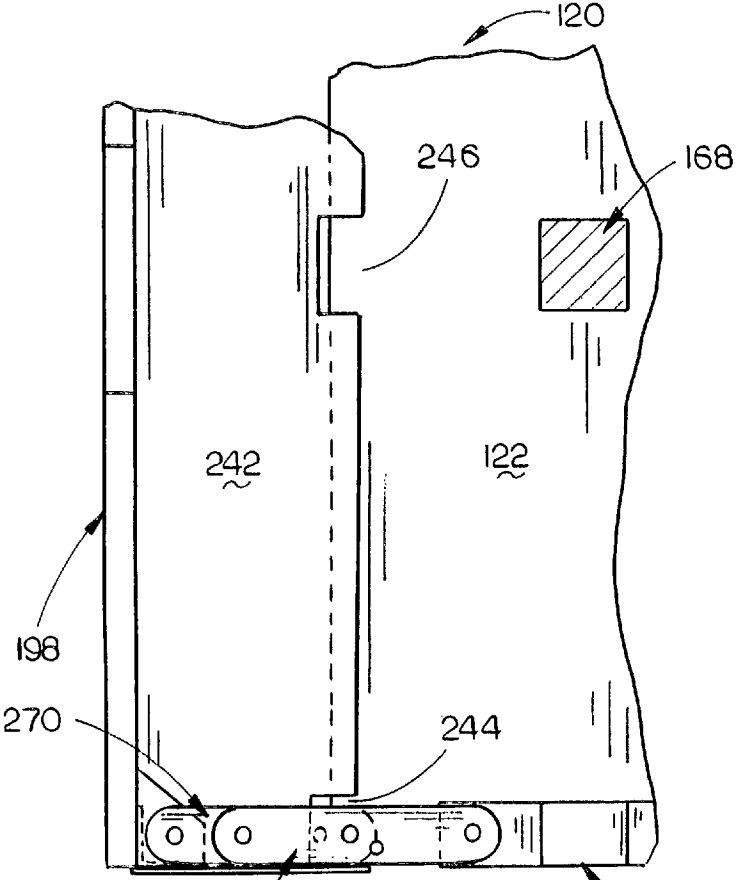
FIG. 12 is a partial top view illustrating the personnel basket in its non-collapsed or working position.
Figure 14:
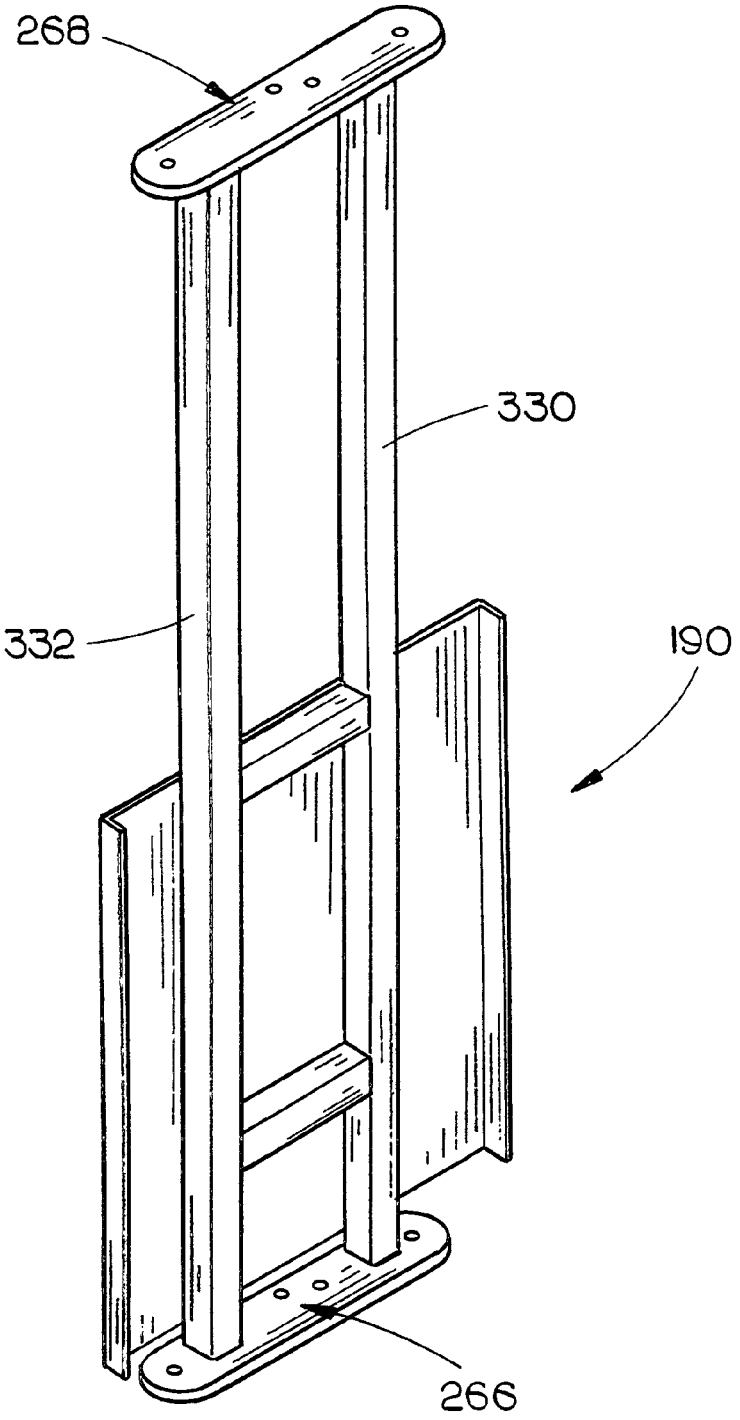
FIG. 14 is a perspective view illustrating one of the end wall sections.

When the hinge assembly 178 is in the folded position of FIG. 11, a locking pin 334 extends downwardly through opening 280 in hinge plate 266, through opening 304 in hinge plate 270, through opening 316 in hinge plate 272 and through opening 292 in hinge plate 268 to maintain the hinge assembly 178 in its folded or collapsed position. The hinge assemblies 180, 186 and 188 are similarly locked in their folded or collapsed positions. Hinge assemblies 174, 176, 182 and 184 may be similarly locked if so desired. In the folded positions, the hinge assemblies cause the end walls 190 and 192 to fold together and the end walls 194 and 196 to fold together so that the width of the basket 120 will be less in its folded position than in its non-folded position.

Figure 10:
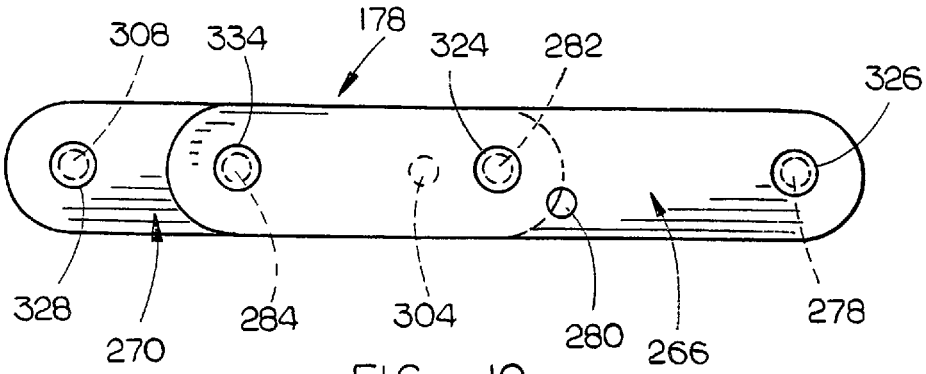
FIG. 10 is a top view of one of the hinge assemblies in its first position wherein the hinge assembly maintains the personnel basket in its non-collapsed or working position.

When the hinge assembly 178 is in its non-folded, extended or working position of FIG. 10, the hinge plates of hinge assembly 178 will be parallel to one another. The hinge assembly 178 is locked in its extended position by the locking pin 334 which extends downwardly through opening 284 in hinge plate 266 of hinge assembly 178, through opening 306 in hinge plate 270, through opening 318 in hinge plate 272 and through opening 292 in hinge plate 268. The hinge assemblies 180, 186 and 188 will be similarly locked in their extended position. When the hinge assemblies are in their extended position, the end walls 190 and 192 will be parallel to one another and end walls 194 and 196 will be parallel to one another so that the side walls 198 and 206 are spaced farther apart than when in their folded or collapsed position.

Figure 9:
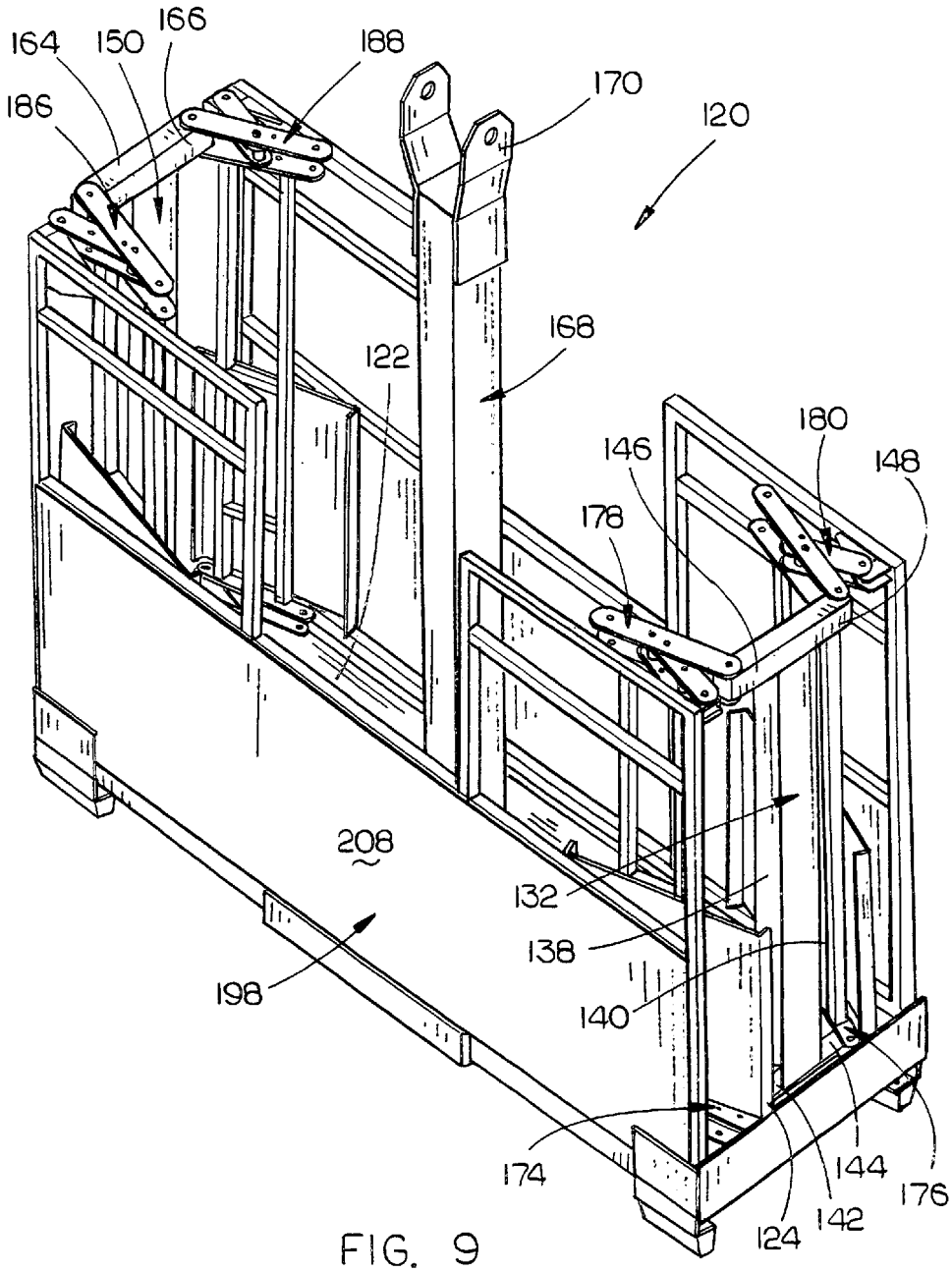
FIG. 9 is a perspective view of the basket of FIG. 8 which shows the basket in its collapsed or folded position for stowing.

Assuming that the jib boom and the personnel basket 120 of the instant invention are in their stowed positions with the hinge assemblies 174, 176, 178, 180, 182, 184, 186 and 188 being in their folded positions with the hinge assemblies 178, 180, 186 and 188 being locked in their folded positions, the basket 120 will be in its collapsed position of FIG. 9.

The boom structure is then operated so that the jib boom moves the basket 120 to a position wherein the basket 120 is suspended a few inches above the ground. The hinge assemblies 178, 180, 186 and 188 are then unlocked from their folded positions by removing the locking pin 334 from those hinge assemblies. The side walls 198 and 220 are then manually moved outwardly until the hinge assemblies 174, 176, 178, 180, 182, 184, 186 and 188 are in their extended positions. The locking pins 334 in the hinge assemblies 178, 180, 186 and 188 are then inserted, as described above, to lock the hinge assemblies 178, 180, 186 and 188 in their locked positions. In that extended position, the width of the basket 120 is at its working width.

When it is desired to move the basket 120 to its collapsed position for storage, the locking pins 324 are removed from the hinge assemblies. The side walls 198 and 220 are then manually moved from their expanded or working positions to their stowed positions to decrease the width of the basket 120. At that time, the folded hinge assemblies 178, 180, 186 and 188 may be locked in their folded positions as described above. The jib boom is then operated to place the personnel basket 120 on the vehicle.

When the collapsed personnel basket 120 is stowed on the vehicle, the width of the vehicle will not be "over wide" for highway restrictions.

Thus it can be seen that a novel personnel basket has been provided which is collapsible from an expanded working position to a folded stowed position.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A personnel basket for an aerial lift, comprising:

a generally rectangular and horizontally disposed floor having a first end, a second end, a first side and a second side;

a first upstanding support post having an upper end, a lower end, a first side and a second side;

said lower end of said first support post being secured to said floor at said first end of said floor intermediate said first and second sides of said floor;

said first support post having a first lower hinge bracket extending therefrom at said first side of said first support post adjacent said lower end of said first support post;

said first support post having a second lower hinge bracket extending therefrom at said second side of said first support post adjacent said lower end of said first support post;

said first support post having a first upper hinge bracket extending therefrom at said first side of said first support post adjacent said upper end of said first support post;

said first support post having a second upper hinge bracket extending therefrom at said second side of said first support post adjacent said upper end of said first support post;

a second upstanding support post having an upper end, a lower end, a first side and a second side;

said lower end of second support post being secured to said floor at said second end of said second support post intermediate said first and second sides of said second support post;

said second support post having a first lower hinge bracket extending therefrom at said first side of said second support post adjacent said lower end of said second support post;

said second support post having a second lower hinge bracket extending therefrom at said second side of said second support post adjacent said lower end of said second support post;

said second support post having a first upper hinge bracket extending therefrom at said first side of said second support post adjacent said upper end of said second support post;

said second support post having a second upper hinge bracket extending therefrom at said second side of said second support post adjacent said upper end of said second support post;

a third upstanding post having an upper end and a lower end;

said lower end of said third post being secured to said floor intermediate said first and second ends of said floor and intermediate said first and second sides of said floor;

a first horizontally disposed hinge assembly, having inner and outer ends, which is selectively movable between extended and folded positions;

said inner end of said first hinge assembly being pivotally secured, about a vertical axis, to said first lower hinge bracket on said first support post;

a second horizontally disposed hinge assembly, having inner and outer ends, which is selectively movable between extended and folded positions;

said inner end of said second hinge assembly being pivotally secured, about a vertical axis, to said second lower hinge bracket on said first support post;

a third horizontally disposed hinge assembly, having inner and outer ends, which is selectively movable between extended and folded positions;

said inner end of said third hinge assembly being pivotally secured, about a vertical axis, to said first upper hinge bracket on said first support post;

a fourth horizontally disposed hinge assembly, having inner and outer ends, which is selectively movable between extended and folded positions;

said inner end of said fourth hinge assembly being pivotally secured, about a vertical axis, to said second upper hinge bracket on said first support post;

a fifth horizontally disposed hinge assembly, having inner and outer ends, which is selectively movable between extended and folded positions;

said inner end of said fifth hinge assembly being pivotally secured, about a vertical axis, to said first lower hinge bracket on said second support post;

a sixth horizontally disposed hinge assembly, having inner and outer ends, which is selectively movable between extended and folded positions;

said inner end of said sixth hinge assembly being pivotally secured, about a vertical axis, to said second lower hinge bracket on said second support post;

a seventh horizontally disposed hinge assembly, having inner and outer ends, which is selectively movable between extended and folded positions;

said inner end of said seventh hinge assembly being pivotally secured, about a vertical axis, to said first upper hinge bracket on said second support post;

an eighth horizontally disposed hinge assembly, having inner and outer ends, which is selectively movable between extended and folded positions;

said inner end of said eighth hinge assembly being pivotally secured, about a vertical axis, to said second upper hinge bracket on said second support post;

each of said third, fourth, seventh and eighth hinge assemblies being selectively lockable in said extended and folded positions;

a first upstanding, generally rectangular, end wall having upper and lower ends and inner and outer sides;

said lower end of said first end wall being secured to said first hinge assembly for movement therewith;

said upper end of said first end wall being secured to said third hinge assembly for movement therewith;

a second upstanding, generally rectangular, end wall having upper and lower ends and inner and outer sides;

said lower end of said second end wall being secured to said second hinge assembly for movement therewith;

said upper end of said second end wall being secured to said fourth hinge assembly for movement therewith;

a third upstanding generally rectangular end wall having upper and lower ends and inner and outer sides; said lower end of said third end wall being secured to said fifth hinge assembly for movement therewith;

said upper end of said third end wall being secured to said seventh hinge assembly for movement therewith;

a fourth upstanding, generally rectangular, end wall having upper and lower ends and inner and outer sides;

said lower end of said fourth end wall being secured to said sixth hinge assembly for movement therewith;

said upper end of said fourth end wall being secured to said eighth hinge assembly for movement therewith;

a first upstanding side wall having an upper end, a lower end, a first end, a second end, an outer side and an inner side;

said first side wall having a first lower hinge bracket extending inwardly from said inner side of said first side wall adjacent said lower end of said first side wall at said first end of said first side wall;

said first side wall having a first upper hinge bracket extending inwardly from said inner side of said first side wall adjacent said upper end of said first side wall at said first end of said first side wall;

said first side wall having a second lower hinge bracket extending inwardly from said inner side of said first side wall adjacent said lower end of said first side wall at said second end of said first side wall;

said first side wall having a second upper hinge bracket extending inwardly from said inner side of said first side wall adjacent said upper end of said first side wall at said second end of said first side wall;

said outer end of said first hinge assembly being pivotally secured, about a vertical axis, to said first lower hinge bracket of said first side wall;

said outer end of said third hinge assembly being pivotally secured, about a vertical axis, to said first upper hinge bracket of said first side wall;

said outer end of said fifth hinge assembly being pivotally secured, about a vertical axis, to said second lower hinge bracket of said first side wall;

said outer end of said seventh hinge assembly being pivotally secured, about a vertical axis, to said second upper hinge bracket of said first side wall;

a second upstanding side wall having an upper end, a lower end, a first end, a second end, an outer side and an inner side;

said second side wall having a first lower hinge bracket extending inwardly from said inner side of said second side wall adjacent said lower end of said second side wall at said first end of said second side wall;

said second side wall having a first upper hinge bracket extending inwardly from said inner side of said second side wall adjacent said upper end of said second side wall at said first end of said second side wall;

said second side wall having a second lower hinge bracket extending inwardly from said inner side of said second side wall adjacent said lower end of said second side wall at said second end of said second side wall;

said second side wall having a second upper hinge bracket extending inwardly from said inner side of said second side wall adjacent said upper end of said second side wall at said second end of said second side wall;

said outer end of said second hinge assembly being pivotally secured, about a vertical axis, to said first lower hinge bracket of said second side wall;

said outer end of said fourth hinge assembly being pivotally secured, about a vertical axis, to said first upper hinge bracket of said second side wall;

said outer end of said sixth hinge assembly being pivotally secured, about a vertical axis, to said second lower hinge bracket of said second side wall;

said outer end of said eighth hinge assembly being pivotally secured, about a vertical axis, to said second upper hinge bracket of said second side wall;

said first side wall having a horizontally disposed floor portion at said second lower end of said first side wall which extends inwardly therefrom for slidable engagement with said floor of the basket;

said second side wall having a horizontally disposed floor portion at its said lower end of said second side wall which extends inwardly therefrom for slidable engagement with said floor of the basket.

* * * * *